United States Patent [19]

Asai et al.

[11] Patent Number: 4,749,356

[45] Date of Patent: Jun. 7, 1988

[54] PROBE FOR IN-CIRCUIT EMULATOR

[75] Inventors: Hironobu Asai; Takeshi Oikawa, both of Tokyo, Japan

[73] Assignee: Ando Electric Co., Ltd., Tokyo, Japan

[21] Appl. No.: 9,158

[22] Filed: Jan. 30, 1987

[30] Foreign Application Priority Data

Jan. 31, 1986 [JP] Japan ..... 61-13070[U]

[51] Int. Cl.[4] ..... H01R 13/04

[52] U.S. Cl. ..... 439/67; 439/499; 439/876

[58] Field of Search ..... 439/66, 67, 77, 492, 439/499, 874–876

[56] References Cited

U.S. PATENT DOCUMENTS 4,526,432 7/1985 Cronin ..... 439/499

*Primary Examiner*—Joseph H. McGlynn

*Attorney, Agent, or Firm*—Flynn, Thiel, Boutell & Tanis

[57] ABSTRACT

A probe for an in-circuit emulator comprises flexible substrates, pins provided at one end of the substrates for connecting the flexible substrates with an LSI package, a base mounted on the flexible substrates and having a penetration hole for holding the pins, and a presser plate mounted on the flexible substrates and having a hole, characterized in that the base and presser plate sandwich the flexible substrates and pins for connecting the flexible substrates with the pins.

11 Claims, 2 Drawing Sheets

PROBE FOR IN-CIRCUIT EMULATOR

BACKGROUND OF THE INVENTION

1. Field of the Invention:

The present invention relates to a probe for an in-circuit emulator, more particularly to an improved connecting element in the probe for an in-circuit emulator for connecting the probe for an in-circuit emulator with an LSI package of a leadless chip carrier or a pingrid array and the like.

2. Description of Prior Art:

An in-circuit emulator is an emulating device for substituting a part of the circuit to be mounted on an actual device for another circuit system. There is a case to use a flexible substrate as a probe for the in-circuit emulator to match an LSI package of a leadless chip carrier or a pingrid array.

A conventional probe for the in-circuit emulator using a flexible substrate is described with reference to FIGS. 4 to 6.

FIG. 4 is a schematic view of a conventional probe comprising a flexible substrate 1 having a pattern 4 formed thereon, a connector 2 for connecting the flexible substrate 1 with an in-circuit emulator (not shown), and a connecting element 3 where an LSI package mounted on the actual device is detached therefrom and attached thereto and the detachment and attachment is repeatedly effected.

FIG. 5 shows a schematic structural view of a conventional connecting element 3 in which the substrate 1 composed of an upper substrate 9 and lower substrate 10 is mounted on a base 8. The number of conductors in the flexible substrate is regulated according to the number of pins of the LSI package. There are LSI packages having 100 to 150 pins among the available LSI package. Only one substrate 1 does not match all such LSI packages so that a plurality of flexible substrates are required. Pins 5 for connecting the LSI package are connected with the flexible substrates 9, 10 via a land pattern 8A provided on the base 8 and a land pattern 8B provided on the flexible substrate 9 as shown in FIG. 6 which is an enlarged sectional view of the connecting state in FIG. 5. Inasmuch as an area of the base 8 is smaller than that of the flexible substrate 9, illustrated later in FIG. 2, there is a problem that a design of the pattern is greatly limited. As described above, although the flexible substrates 9 and 10 are fixedly mounted on the base 8 by the band 6, the flexible substrates are not completely fixed but liable to be loosened to be deformed. A stress produced by the deformation is liable to be focused at a solder 7, and the flexible substrates 9, 10 and the patterns respectively on the flexible substrates respectively around the soldered portion 7. Therefore, the portion to be soldered is liable to be broken when the connecting element 3 is repeatedly attached to or detached from the LSI packages. There is another problem according to the prior art that a facility to effect a reflow of solder between the flexible substrates 9, 10 and the base 8 is required.

SUMMARY OF THE INVENTION

It is an object of the present invention to provide a probe for an in-circut emulator having a connecting element which is hardly ever broken when it is repeatedly attached to or detached from the LSI packages of the pingrid array and the like.

The above and other objects, features and advantages of the present invention will become more apparent from the following description when taken in conjunction with the accompanying drawings.

PREFERRED EMBODIMENT OF THE INVENTION

Figure 1:
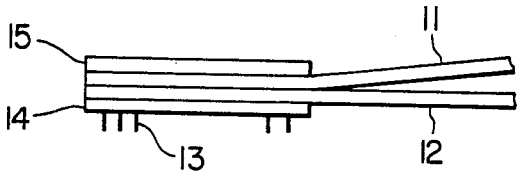
FIG. 1 is a structural view illustrating an embodiment of the present invention.
Figure 2:
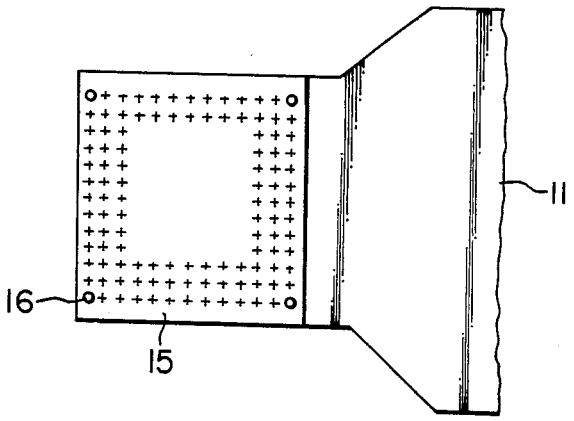
FIG. 2 is a plan view in FIG. 1.
Figure 4:
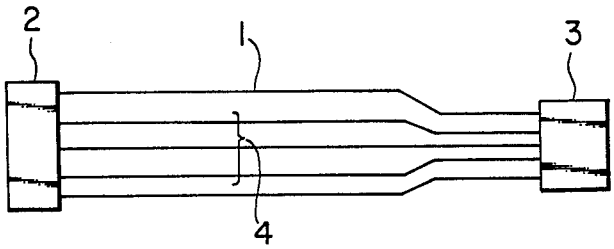
FIG. 4 (PRIOR ART)
FIG. 4 is a schematic view of a conventional probe.
Figure 5:
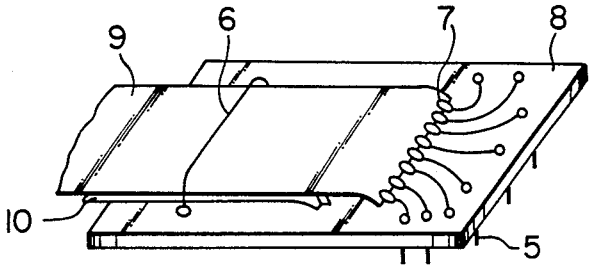
FIG. 5 (PRIOR ART)
FIG. 5 is a structural perpsective view of a part in FIG. 4.
Figure 6:
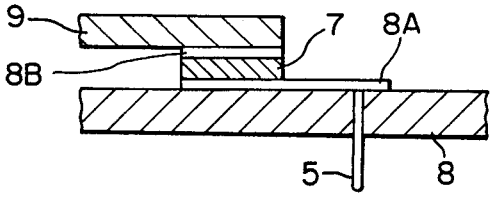
FIG. 6 (PRIOR ART)
FIG. 6 is an enlarged view of a part in FIG. 5.

The present invention will be described with reference to FIGS. 1 to 3. The numerals used in FIGS. 4 to 6 are applied to FIGS. 1 to 3. Designated at 11 and 12 are flexible substrates, 13 is a pin, 14 is a base, 15 is a presser plate. Two flexible substrates are used in in FIG. 1, but the flexible substrate may be used in the number of one or more. The number and disposition of the pins 13 match the packages of an pingrid array and the like. The pins 13 penetrate the base 14 made of a non-deformative plate and are replaceable by the LSI packages mounted on the actual device. The presser plate 15 presses the flexible substrates 11, 12. The pressure plate 15 has many holes 16 penetrated therethrough as show in FIG. 2, and each of the holes 16 has a structure such that the top of the pins 13 does not appear above the surface of the holes, namely, the upper surface of the presser plate 15 does not contact with the top of the pins 13.

Figure 3:
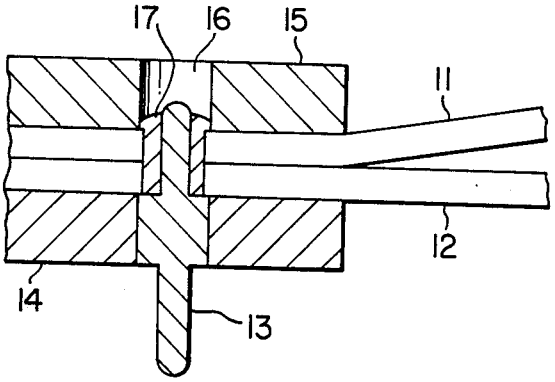
FIG. 3 is an exploded view of a part in FIG. 1.

The flexible substrates 11, 12 and the pin 13 are fixed by effecting a through hole solder and the presser plate 15 is mounted on the flexible substrates 11, 12 with use of an adhesive agent as shown in FIG. 3.

With the arrangement as shown in FIG. 3, the pins 13 will not be bent even if the flexible substrates 11, 12 are bent since the flexible substrates 11 ad 12 are sandwiched by the base 14 and the presser plate 15 to fixedly hold same to the whole of the connecting element 3 including the pins 13.

According to the present invention, the probe will not be broken when the connecting element is repeatedly attached to or detached from the LSI package since the flexible substrates used as a probe for the pingrid array is fixedly sandwiched by the base and the presser plate.

Further, it makes possible to design the pattern of the connecting element freely to some extent since the land patterns required in the prior art are not required according to the present invention.

While we have described certain present preferred embodiment of the invention, it is to be distinctly understood that the invention is not limited thereto but may be otherwise variously embodied within the scope of the following claims.

What is claimed is:

1. A probe for an in-circuit emulator comprising:

a generally plate-like base;

a plurality of pins extending through said base and spaced from each other, said pins each having exterior end means protruding from one side of said base for attachment to and detachment from LSI packages, said pins each having interior end means protruding from the opposite side of said base;

at least one flexible sheet-like substrate having an end portion lying on said one side of said base, said flexible substrate end portion having a plurality of holes therethrough corresponding in lateral location to the location of said pins on said base, said pin interior end means protruding loosely through said holes in said flexible substrate end portion;

a presser plate, said flexible substrate end portion being sandwiched between said base and presser plate, means fixing said presser plate on said flexible substrate end portion, said presser plate having a plurality of holes through the thickness thereof and corresponding in lateral location to the location of said pins, said through holes in said presser plate being at least as large in diameter as said holes in said flexible substrate end portion, said pin interior ends being radially loose in said holes in said presser plate;

a mass of solder snugly radially interposed between and engaging (1) a said pin at the interior end portion thereof and (2) the surface of the corresponding said hole in said flexible substrate end portion, said holes in said pressure plate defining solder entrance channel means for solder, said solder extending from said holes in said flexible substrate into said holes in said presser plate and thereby also engaging said presser plate; and means fixing said presser plate on said flexible substrate end portion.

2. A probe for an in-circuit emulator according to claim 1, wherein said pins are connected with an LSI package of a leadless carrier.

3. A probe for an in-circuit emulator according to claim 1, wherein said pins are connected with an LSI package of a pingrid array.

4. A probe for an in-circuit emulator according to claim 1, wherein the number and disposition of said pins match the number and disposition of said LSI package.

5. A probe for an in-circuit emulator according to claim 1, wherein the number of said substrates is more than one.

6. A probe for an in-circuit emulator according to claim 1, wherein said base is made of an non-deformative plate.

7. A probe for an in-circuit emulator according to claim 1, wherein said pins are replaceable with various types of LSI package.

8. A probe for an in-circuit emulator according to claim 1, in which said solder extends from said holes in said flexible substrate into said holes in said presser plate and thereby also engages said presser plate.

9. A probe for an in-circuit emulator according to claim 1, in which said pins each have a radially enlarged midportion snugly engaged by said base and extending substantially through the thickness of said base, the end of said radially enlarged pin midportion being flush with said one and opposite sides of said base.

10. A probe for an in-circuit emulator according to claim 9, in which a given said hole in said flexible substrate end portion is smaller in diameter than said midportion of the corresponding said pin and than the corresponding said through hole in said presser plate, said generally cylindrical solder mass extending into end contact with the opposed end of said enlarged midportion of said pin in radially inward offset relation from the material of said base, said solder mass having a lip spread radially beyond the edge of the hole in the flexible substrate end portion to overlie the presser plate engaging surface of the substrate and therewith mechanically lock said substrate on said base with said solder lip.

11. A probe for an in-circuit emulator according to claim 10, in which said means fixing said presser plate on said flexible substrate comprises an adhesive bond and is independent of said base.

* * * * *